United States Patent [19]

Fischer et al.

[11] 4,365,553

[45] Dec. 28, 1982

[54] SINGLE-SHEET ROTARY OFFSET PRINTING MACHINE

[75] Inventors: Hermann Fischer, Augsburg; Johannes M. Schubert, Mainhausen, both of Fed. Rep. of Germany

[73] Assignee: M.A.N.-Roland Druckmaschinen Aktiengesellschaft, Offenbach am Main, Fed. Rep. of Germany

[21] Appl. No.: 308,363

[22] Filed: Oct. 5, 1981

[30] Foreign Application Priority Data

Oct. 25, 1980 [DE] Fed. Rep. of Germany ..... 3040388

[51] Int. Cl.[3] ..... B41F 13/24

[52] U.S. Cl. ..... 101/232

[58] Field of Search ..... 101/232, 174, 183, 229, 101/216, 217; 271/184–186

[56] References Cited

U.S. PATENT DOCUMENTS

| | | | |
|---|---|---|---|
| 3,174,748 | 3/1965 | Roberts et al. | 101/232 X |
| 3,334,897 | 8/1967 | Sharkey | 101/232 X |
| 3,342,129 | 9/1967 | Weigl | 101/232 X |
| 4,222,326 | 9/1980 | Mathes et al. | 101/232 |

FOREIGN PATENT DOCUMENTS

| | | | |
|---|---|---|---|
| 881043 | 6/1953 | Fed. Rep. of Germany | 101/232 |
| 1158394 | 2/1958 | Fed. Rep. of Germany | 101/232 |
| 2113634 | 9/1972 | Fed. Rep. of Germany | 101/232 |
| 2452050 | 5/1976 | Fed. Rep. of Germany | 101/232 |
| 2914362 | 10/1980 | Fed. Rep. of Germany | 101/232 |
| 289392 | 3/1953 | Switzerland | 101/183 |

*Primary Examiner*—E. H. Eickholt

*Attorney, Agent, or Firm*—Frishauf, Holtz, Goodman & Woodward

[57] ABSTRACT

To provide for compact construction with minimum components, and permit application of two prime prints and one verso print, a chain transport system (9, 14, 15) is carried over the rubber blanket cylinder (7) applying the second prime printing. The sheet is fed between two blanket cylinders (3, 5) applying, respectively, verso and a first prime printing, held by grippers on the verso blanket cylinder and transferred to grippers (15) on the chain for transfer to a delivery station (10) or a further printing station (FIG. 2: 13), for example by use of a further transport drum (12) for proper positioning of the sheet.

9 Claims, 2 Drawing Figures

SINGLE-SHEET ROTARY OFFSET PRINTING MACHINE

Cross reference to related application, assigned to the assignee of the present application: U.S. Ser. No. 308,364, filed Oct. 5, 1981, Fischer.

The present invention relates to a rotary offset printing machine, and more particularly to a printing machine having at least one printing station for prime printing and verso printing on single sheets which are individually fed to the printing system, and using three plate cylinder - rubber blanket cylinder pairs, in which the single sheets are transported through the printing machine by a chain transport system.

Background

A rotary sheet printing machine for both prime and verso printing of the type to which the present invention relates has been described in German Patent Utility Model DE-GM 1 158 394, see particularly FIG. 2. The sheet to be printed on is gripped by grippers on a rubber blanket cylinder which carries the verso printing information, and which transports the sheets past two further rubber blanket cylinder which apply the prime printing information. Thereafter, the sheet which now has two prime and one verso printed information thereon is fed to a delivery drum which further transports the sheet to a two-part transport chain system to, in turn, move the sheet to the final delivery station, for example a delivery stack. Use of a delivery drum, or removal drum, substantially increases the space requirement for the machine and, further, increases costs thereof. The sheet removal drum interferes with accessibility to the printing cylinders themselves and to the associated apparatus, and particularly to the damping fountain system and the ink roller train system.

The Invention

It is an object to provide a printing machine which permits both prime printing and verso printing, which is compact and less expensive and difficult to construct than prior art apparatus.

Briefly, two rubber blanket cylinders of cylinder - plate pairs and providing prime printing are used. A chain transport system is provided, looped about the second blanket cylinder which effects prime printing and which receives the sheet after the first prime printing and verso printing has been effected by respective first and third blanket cylinders. The chain transport system has grippers which take the sheet from the blanket cylinder and remove the sheet from the printing station directly from the second printing cylinder which applied prime printing to the sheet.

The machine has the advantage over known apparatus that the transport path of the sheet is decreased and no transfer drum is required, so that all cylinders of the printing station, and the associated apparatus and principally damping and ink train rollers are easily accessible. Further, the overall system is cheaper to construct.

DRAWINGS

FIG. 1 is a highly schematic side view of a rotary offset printing machine for double prime printing and verso printing; and FIG. 2 is a highly schematic side view of a multiple printing station printing machine in which each of the printing stations apply double prime printing and single verso printing.

DETAILED DESCRIPTION

Figure 1:
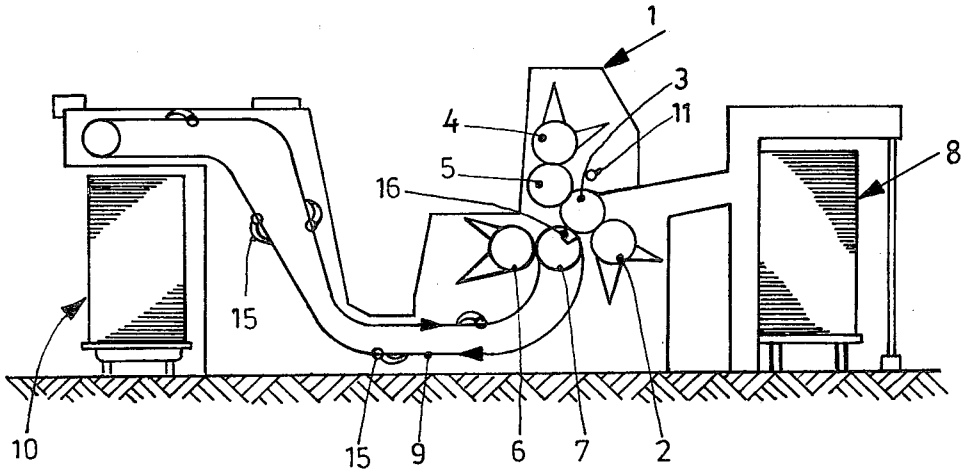

A printing station 1—see FIG. 1—has three rubber cylinder - plate cylinder pairs thereon. A sheet from a stack 8 is transported to the printing station 1 by any suitable and well known transport apparatus, for example a gripper device oscillating back-and-forth and supplying the topmost sheet from the stack 8 to a rubber cylinder 3, which is in contact with the plate cylinder 2. Additionally, the printing station 1 has a first rubber cylinder - plate cylinder combination 5, 4 to apply a first prime printing, and a second rubber cylinder - plate cylinder combination 7, 6 to apply a second prime printing. The plate cylinder 2—rubber cylinder combination applies the verso printing.

The sheet is passed between the rubber cylinder 3 and the rubber cylinder 5 to apply, simultaneously, the first verso printing and prime printing, and then carried between the rubber cylinder 3 and the second prime printing rubber cylinder 7. The rubber blanket cylinder 3 thus acts as an impression cylinder for the respective prime printing rubber blanket cylinders 5, 7; and the prime printing blanket cylinder 5 acts as an impression cylinder for the verso printing rubber blanket cylinder 3.

In accordance with a feature of the invention, the rubber blanket cylinder 7 has a chain transport system 9 looped thereabout. The chain has grippers which are shown schematically at 15, applied in customary and well known manner, which grip a sheet transported to the printing station 1 from the stack 8, and continue to transport the sheet to a sheet delivery station 10. The sheet is gripped by the grippers 15 of the chain transport system after the first prime printing and the verso printing are effected by the blanket cylinders 5, 3. The grippers 15 carry the sheet partially about the blanket cylinder 7 to apply the second prime printing between the blanket cylinders 3 and 7, and then remove the sheet from the printing station.

The chain transport system thus guides the sheet on the shortest possible path through and from the printing station to eventually the sheet delivery station 10, without requiring a transfer drum. The blanket cylinder 3 can grip sheets without requiring a special delivery drum, and blanket cylinder constructions which include grippers located in axially extending grooves are well known, and the blanket cylinder 3 can use any such construction. It is desirable to provide an additional pneumatic device 11 to supply some suction on sheets being transported towards the blanket cylinder 3 to prevent premature contact of the sheet with the surface of the blanket cylinder 3 which carries the information for the reverse or verso printing. Alternatively, and instead of a pneumatic device 11, an electrostatic hold-off device can be used, located in the position of the pneumatic device 11 and providing an electrostatic charge—as well known—in order to firmly and definitively adhere the sheet to the surface of the blanket cylinder 3 immediately upon being gripped so that, upon subsequent printing steps, the sheet will not shift anymore and thus result in smeared printing.

Figure 2:
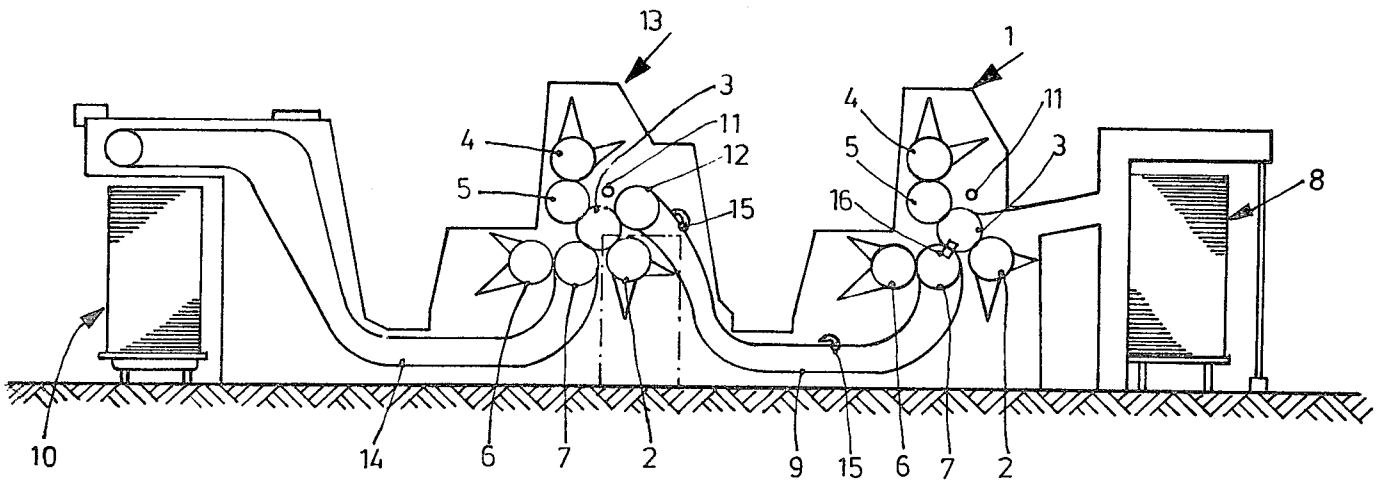

FIG. 2 illustrates an arrangement in which a second printing station 13, which can be similar to the printing station 1, is coupled to the printing station 1. In principle, the printing station 13 is identical to the printing station 1, and similar items have been given similar reference numerals. The electrostatic device 11' of printing station 13 replaces pneumatic device 11. The chain transport device 9 of FIG. 1 has been replaced by the chain 9' which, rather than applying the sheet to a delivery stack, supplies the sheet from the second blanket cylinder 7 to a supply drum 12 in the second station 13, so that the transfer of the sheet from the station 1 to the station 13 will be on the correct side.

The sheets are transported around the blanket cylinder 3 by grippers 16 located thereon which fit into a suitable groove of the blanket cylinder; and which, further, can fit into a matching groove in the second prime printing cylinder 7, suitably axially staggered with respect to the position of the grippers 15 on the chain 9, 9', respectively.

The sheet can be printed on in the stations 1 and 13 selectively. For example, the station 13 can apply double prime printing and a further verso printing; after having passed through the printing station 13, a further chain transport 14 looped about the second prime printing cylinder 7 removes the sheet to a final delivery station 10, as in the embodiment of FIG. 1, the chain 14 corresponding to chain 9 of FIG. 1. The sheet, thus, can receive double prime printing and a further verso printing in station 13, by passing the sheet about the rubber cylinder 7 in the second printing station 13 which applies the second prime printing of the second station, for further removal by chain 14.

Of course, and in accordance with the requirements, the respective blanket cylinders can be placed out of printing with the sheet to be printed, so that the following combination of printing is possible:

| Prime | Verso |
|---|---|
| 1 | 0 |
| 2 | 0 |
| 1 | 1 |
| 2 | 1 |
| 0 | 1. |

The above possibilities are for a single printing station; by use of multiple printing stations, as in FIG. 2, the variations of course increase correspondingly.

Accessibility is insured by positioning the verso rubber cylinder 3 such that the associated plate cylinder 2 is therebeneath, and beneath the supply of sheets from the stack 8 or the transfer drum 12 (FIG. 2), respectively; the plate cylinder 6 associated with the rubber blanket cylinder about which the chain is looped is above the chain, and the rubber cylinder 5 applying the first prime printing is located somewhat above the rubber cylinder applying the verso printing, and plate cylinder 4 is thereabove. The chain 9 can, actually, consist of two chain portions, each looped about an axial end portion of the cylinder 7, with gripper carrying bars extending between the chain portions.

We claim:

1. Rotary offset sheet printing machine for prime and verso printing having a printing station (1, 13) including three paired rubber blanket cylinder - plate cylinder combinations (2,3; 4,5; 6, 7), each having a first, second and third rubber blanket cylinder (3, 5, 7);

a transport chain system including a transport chain (9, 9', 14) and gripper means (15) on the chain, and means for transporting the sheets between the first rubber cylinder (5) and past the third rubber cylinder (7), said first and second rubber cylinders (3, 5) and the second rubber cylinder (5) applying, respectively, verso and prime printing thereon, and the third rubber cylinder (7) applying a second prime printing, wherein, in accordance with the invention, the transport chain (9, 9', 14) is carried about the third rubber cylinder (7) applying the second prime printing, and receive sheets from the first rubber cylinder (3) after having the first prime printing and the verso printing applied by the second and first rubber blanket cylinders, respectively, the transport chain leading the sheet over part of the circumference of the third rubber cylinder (7) to thereby have the second prime printing applied, with the first rubber cylinder forming the printing cylinder for the third rubber cylinder, said transport chain then carrying the sheet out of the printing station (1).

2. Printing machine according to claim 1, further including an electrostatic sheet hold-down charging apparatus (11') located in advance of the second rubber cylinder applying the first prime printing and spaced from the first rubber cylinder (3) applying the verso printing.

3. Printing machine according to claim 1, further including a pneumatic sheet lifting device (11) positioned spaced from the first rubber cylinder (3) applying the verso printing to space the sheet from said first rubber blanket cylinder after acceptance of the sheet thereby.

4. Printing machine according to claim 1, wherein the first rubber cylinder includes gripper means (16) to grip the sheet and carry the sheet between the first and second rubber blanket cylinders for subsequent transfer to the grippers (15) on the transport chain (9, 9', 14).

5. Printing machine according to claim 1, wherein two printing stations (1, 13) are provided for serial prime and verso printing;

and wherein the transport chain (9') is guided in a path to remove the sheet from the first printing station (1) and feed the sheet to the first rubber blanket cylinder (3) of the second printing station (13).

6. Printing machine according to claim 5, wherein the second printing station (13) includes a sheet transport drum (12) positioned to receive sheets from the chain (9') transporting the sheets from the first printing station (1) to the second printing station (13).

7. Printing machine according to claim 1, further including a delivery device station (10), the chain (9, 14) transporting the sheet from the printing station to the delivery station.

8. Printing machine according to claim 5, further including a delivery station (10);

and wherein the chain (14) leading from the last one (13) of the printing stations (1, 13) delivers the sheet to the delivery station (10).

9. Printing machine according to claim 1, wherein the plate cylinder (2) associated with the first rubber blanket cylinder (3) is located below the first rubber blanket cylinder (3) and below a sheet feeding device (8, 12);

the plate cylinder (6) associated with the third rubber blanket cylinder and applying the second prime printing being located above the chain transport system (9, 9', 14);

and the plate cylinder (4) associated with the second rubber blanket cylinder and applying the first prime printing is located above the second rubber blanket cylinder.

* * * * *